United States Patent [19]

Pearl

[11] 4,385,956

[45] May 31, 1983

[54] APPARATUS AND METHODS FOR SPREADING SHEET MATERIAL

[75] Inventor: David R. Pearl, West Hartford, Conn.

[73] Assignee: Gerber Garment Technology, Inc., South Windsor, Conn.

[21] Appl. No.: 245,364

[22] Filed: Mar. 19, 1981

[51] Int. Cl.[3] ..... B25B 11/00; B23B 31/04

[52] U.S. Cl. ..... 156/247; 269/8; 269/55; 269/56; 269/289 R; 156/289; 156/391; 156/537; 156/576; 156/577

[58] Field of Search ..... 156/247, 289, 323, 391, 156/523, 537, 574, 576, 577; 269/8, 55, 56, 289 R

[56] References Cited

U.S. PATENT DOCUMENTS

| | | | |
|---|---|---|---|
| 3,942,781 | 3/1976 | Gerber | 269/289 R |
| 3,971,691 | 7/1976 | Cairns | 156/577 |
| 4,066,177 | 1/1978 | Gidley et al. | 269/8 |

*Primary Examiner*—Caleb Weston

*Attorney, Agent, or Firm*—McCormick, Paulding & Huber

[57] ABSTRACT

An apparatus for working on limp sheet material has a support surface with a high coefficient of static friction relative to the limp sheet material. A sheet of low friction material is attached at one end to a carriage supported to move longitudinally of the support surface and is spread on the support surface by advancing the carriage. The limp sheet material is spread on the support material and shifted relative to the support material to align the sheet material in predetermined position relative to the apparatus. The carriage is retracted and the support material simultaneously withdrawn from between the limp sheet material and the support surface by winding the support material onto a pay-off/take-up roll. A brush and a roller carried by the carriage smooth wrinkles from the limp sheet material and press the material into engagement with the support surface as the carriage retracts.

16 Claims, 9 Drawing Figures

APPARATUS AND METHODS FOR SPREADING SHEET MATERIAL

BACKGROUND OF THE INVENTION

This invention relates in general to apparatus and methods for spreading sheet material in relaxed or limp condition on a lay table or the like and deals more particularly with improved apparatus for spreading sheet material on a table surface which has a high coefficient of static friction relative to the sheet material, as, for example, a tacky surface, to resist movement of the sheet material while it is worked on by a tool, such as a cutting tool or marking tool. Such apparatus may be used to mark patterns on or to cut pattern pieces from a single layer or a layup comprising a relatively few layers of limp sheet material. Any wrinkles which may develop in the material as it is spread are difficult to remove, because the high friction surface of the table resists shifting of the material. A further problem may be encountered where the sheet material has a regular pattern which must be accurately aligned in a predetermined manner relative to the table surface. Such a problem may be encountered, in marking patterns on or cutting pattern pieces from a single sheet of fabric which has a pin-stripe pattern, for example, such as may be used in the fabrication of a custom-made garment. The present invention is concerned with these problems.

SUMMARY OF THE INVENTION

In accordance with the present invention, there is provided an improved apparatus and method for spreading sheet material on a support surface in relaxed or limp condition. The sheet and the support surface have a high coefficient of static friction relative to each other. The apparatus has a spreader assembly, which includes a spreader carriage, means supporting the spreader carriage for movement in one and an opposite direction relative to the support surface, a sheet of support material which has a low coefficient of static friction relative to the support surface and the limp sheet material, means for moving the support material into overlying relation with an associated portion of the support surface in response to movement of the spreader carriage in one direction relative to the support surface. After the support material is spread on the support surface the limp sheet material is spread on the support material. The sheet material is shifted relative to the support material to align it in predetermined position relative to the support surface. The support material is then withdrawn from its position between the sheet material and the support surface while a portion of the sheet material is restrained against movement relative to the support surface.

DETAILED DESCRIPTION OF PREFERRED EMBODIMENT

Figure 8:
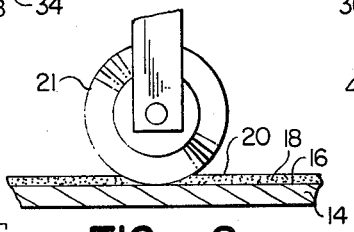
FIG. 8 is a somewhat enlarged fragmentary sectional view taken along the line 8—8 of FIG. 1.
Figure 4:
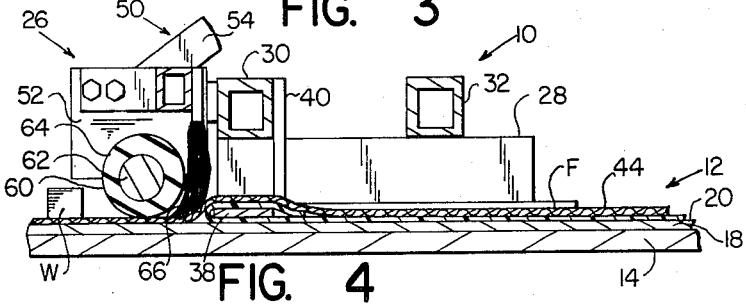
FIG. 4 is a fragmentary sectional view taken along the line 4—4 of FIG. 2.

Turning now to the drawing, a cutting machine embodying the present invention is indicated generally by the numeral 10. The cutting machine 10 is particularly adapted for cutting a single ply or a layup which comprises a relatively few plies of limp sheet material, such as a fabric indicated by the letter F, which, as shown, has a pinstripe pattern. The machine has a cutting table indicated generally at 12 and includes a metal plate 14 which defines an upwardly facing working surface 16. The surface 16 is coated with a material 18 which has a high coefficient of static friction relative to the fabric F and which defines a material supporting surface 20, as best shown in FIGS. 4 and 8. The cutting machine 10 further includes a cutting tool or cutter wheel 21, shown in FIG. 8, which is suspended from a movable tool carriage assembly 22 and supported for movement relative to the carriage assembly and to the table 12 in response to command signals received from a programmable controller, illustrated somewhat schematically in FIG. 1 and designated by the numeral 24, as will be hereinafter more fully described. The cutter wheel 21 is arranged for free rolling engagement with the working surface 16 and is biased toward engagement with the latter surface by biasing means (not shown) to move in cutting engagement with sheet material spread on the table 12 and to cut patterns from the material in response to command signals from the controller 24, in a manner well known in the art. A cutting machine of the aforedescribed type is illustrated and described in the application of Heinz Joseph Gerber and David R. Pearl, for Method and Apparatus for Cutting Sheet Material with a Cutting Wheel, Ser. No. 168,312, filed July 10, 1980, and assigned to the assignee of the present application. For a more complete disclosure of a machine of the aforesaid type reference may be had to the aforesaid application which is hereby adopted by reference as part of the present disclosure.

In accordance with the invention, the machine 10 includes the sheet material spreading apparatus indicated generally at 26 which is utilized to spread sheet material to be cut, such as the fabric F, in a relaxed or limp condition on the material supporting surface 20 defined by the coating 18, which preferably comprises pressure sensitive adhesive sprayed on or otherwise applied to the working surface 16.

Figure 1:
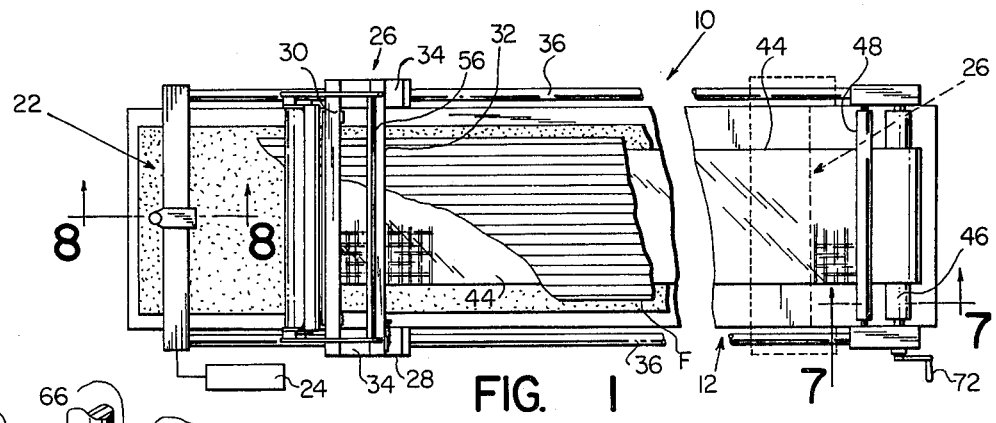
FIG. 1 is a fragmentary plan view of an apparatus for cutting limp sheet material and which includes a spreading apparatus embodying the present invention.
Figure 2:
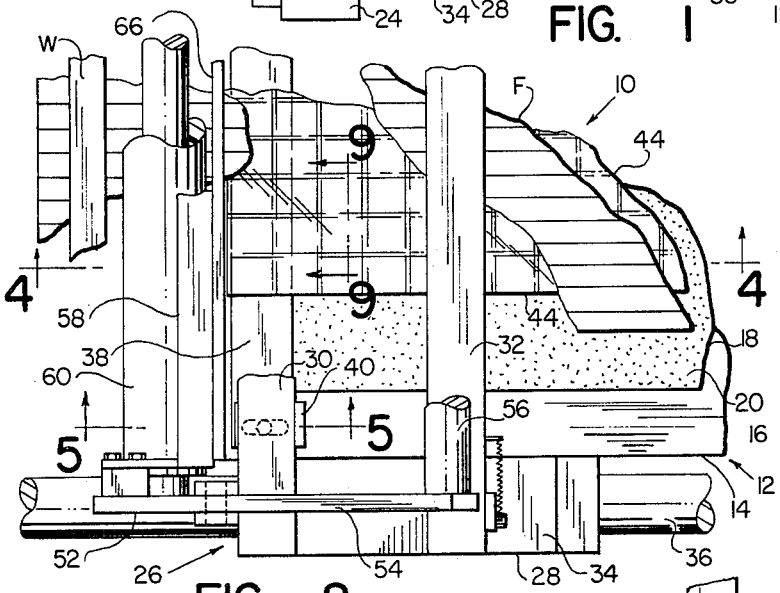
FIG. 2 is a somewhat enlarged fragmentary plan view of the apparatus shown in FIG. 1.
Figure 6:
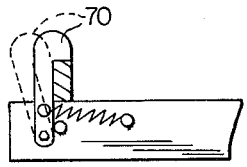
FIG. 6 is a fragmentary sectional view taken along the line 6—6 of FIG. 3.
Figure 3:
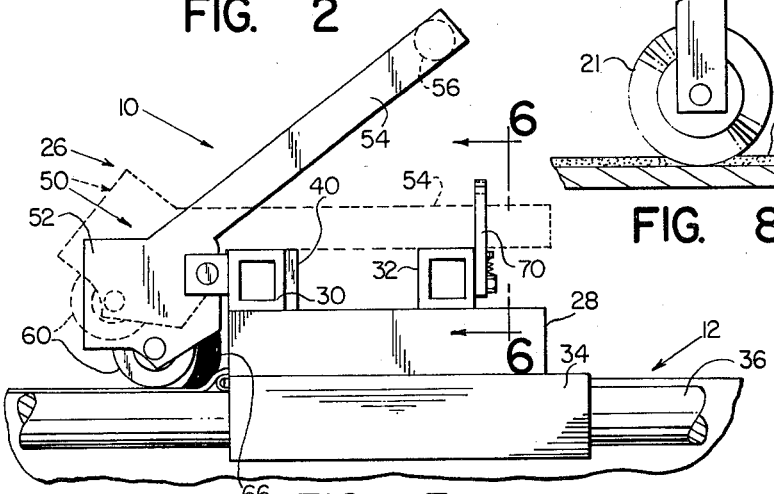
FIG. 3 is a somewhat enlarged fragmentary side elevational view of the apparatus shown in FIG. 1.
Figure 5:
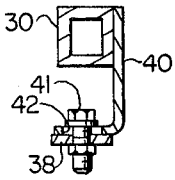
FIG. 5 is a fragmentary sectional view taken along the line 5—5 of FIG. 2.
Figure 7:
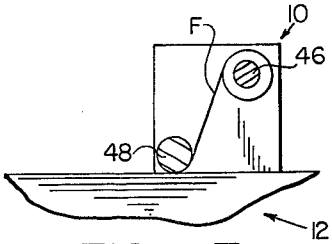
FIG. 7 is a somewhat enlarged fragmentary sectional view taken along the line 7—7 of FIG. 1.

Considering now the spreading apparatus 26 in further detail and referring more particularly to FIGS. 2–6, the spreading apparatus comprises a movable spreader carriage 28 which extends transversely of the table 12. The spreader carriage 28 includes a pair of parallel cross members 30 and 32 supported at opposite ends of slide blocks 34, 34 to travel on guide rods 36, 36, respectively, which extend longitudinally of the table 12 at opposite sides thereof and which retain the carriage assembly in transverse relation to the table. A spreader bar 38, which comprises a part of the carriage assembly, is mounted on a pair of transversely spaced apart brackets 40, 40 which depend from the cross member 30 at opposite sides of the table 12, as best shown in FIGS. 2, 3 and 5. Bolts 41, 41 received in longitudinally extending slots 42, 42 within the brackets 40, 40 adjustably secure the spreader bar 38 to the spreader carriage 28 as best shown in FIG. 5. A sheet of support material or support sheet, indicated at 44 and shown in FIGS. 1, 2 and 4, is attached at one end to the spreader bar 38. More specifically, one end portion of the support sheet 44 is looped around the spreader bar 38 and attached to itself, as best shown in FIG. 4. The opposite end of the support sheet 44 is wound onto a pay-off/take-up roll 46 journalled at one end of the table 12, as shown in FIGS. 1 and 7. The support sheet passes under a guide roll 48 positioned in close proximity to the table surface and to the pay-off/take-up roll 46, as best shown in FIG. 7.

Figure 9:
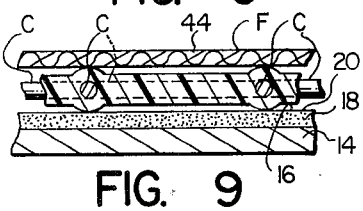
FIG. 9 is a somewhat enlarged fragmentary sectional view taken along the line 9—9 of FIG. 2.

The support sheet 44 is preferably made from slippery material which has a low coefficient of static friction relative to both the supporting surface 20 and the surface of the fabric F. The support sheet 44 is substantially narrower than the plate 14 and is mounted on the spreader bar 38 and the pay-off/take-up roll 46 to extend longitudinally along a central portion of the plate 14 so that side marginal edges of the plate 14 and the material supporting surface 20 are exposed beyond the side marginal edges of the support sheet 44. The illustrated sheet 44 is preferably made from relatively thin low friction plastic material which has longitudinally and transversely extending threads or cords C, C molded within it, as best shown in FIG. 9. The threads impart a grid pattern to the upper and lower surfaces of the sheet 44 and thereby reduce surface contact between the lower surface of the support sheet 44 and the material supporting surface 20 and the upper surface of the support sheet 44 and sheet material spread thereon, such as the fabric F.

The spreader assembly 26 further includes a pressure roller assembly indicated generally at 50 which is pivotally mounted on the forward end of the spreader carriage 28 and which includes a pair of side plates 52, 52, mounted at opposite sides of the carriage 28. Each side plate 52 is pivotally mounted on an associated end portion of the cross member 30 and has an integral handle portion 54. A handlebar 56 connects the handle portions 54, 54 and extends transversely therebetween, as best shown in FIGS. 1 and 2. The side plates 52, 52 are further connected by another cross member 58 which extends transversely of the spreader carriage 28. A pressure roller 60 is journalled on the side plates 52, 52 with its axis extending transversely of the table and comprises a relatively heavy roll 62 which has an outer layer of soft rubber or the like indicated at 64, as shown in FIG. 4.

A brush 66 supported on the cross member 58 extends transversely of the spreader carriage 28 between the spreader bar 38 and the pressure roller 60. The pressure roller assembly 50 is supported for pivotal movement between an active position, shown in full lines in FIG. 3, wherein the surface of the roller 60 and the bristles of the brush 66 are disposed for contact with the material supporting surface 20 or the surface of material spread thereon, and an inactive position, indicated by broken lines, wherein the roller 60 and the brush 66 are supported in vertically spaced relation to the material supporting surface 20. A cam latch 70, best shown in FIG. 6, is biased into holding engagement with one of the handle portions 54, 54 when the roller support assembly 50 is in its inactive position and releasably retains the assembly 50 in the latter position.

Preparatory to spreading onto the table 12 fabric to be cut, the cutter wheel 21 is raised to a position above the material supporting surface 20 and the tool carriage assembly 22 is moved to a position at the forward end of the table, such as shown in FIG. 1, in response to command signals from the controller 24. The pressure roller assembly 50 is latched in its raised or inactive position and the spreader carriage 28, which is normally disposed at the rear end of the cutting table 12 during the cutting cycle, is moved longitudinally of the table and toward the forward end of the table to a position such as shown in FIG. 1. This forward movement of the spreader carriage 28 pulls the material support sheet 44 from the pay-off/take-up roll 46 and spreads it on the material supporting surface 20, as shown in FIG. 1. A sheet of fabric to be cut, such as the sheet F, is then spread on the exposed upper surface of the sheet 44 so that the leading marginal portion of the sheet F is disposed forward of the spreader bar 38 and the leading edge of the support sheet 44 and overlies an associated portion of the material supporting surface 20. Since the coefficient of static friction of the sheet 44 relative to the fabric F is low, the fabric may be readily shifted on and relative to the support sheet 44 so that the pinstripe pattern in the fabric may be properly aligned in predetermined position relative to the longitudinal axis of the table 12 as, for example, in parallel relation to the longitudinal axis of the table. The grid pattern formed by the threads in the plastic support sheet 44 and which defines the upper and lower surfaces of the latter sheet substantially reduces the supporting surface area of the sheet so that the fabric F may be more easily shifted relative to the sheet 44. Aligning the fabric pattern or design in this manner will assure that the fabric pattern will be properly oriented with respect to pattern pieces cut from the fabric in response to control signals received from the controller 24. A weight or bar W is then preferably placed on the forward end portion of the sheet F, as shown in FIGS. 2 and 4, to retain this portion of the sheet in fixed position relative to the table 12.

The fabric sheet F is preferably spread on the support sheet 44 so that its side marginal portions extend beyond the longitudinally extending side edges of the support sheet and overlie exposed marginal portions of the tacky material supporting surface 20 defined by the pressure sensitive coating on the plate 18. The extending side marginal portions of the fabric sheet F are preferably pressed into adhering engagement with the associated underlying pressure sensitive adhesive surface 20 so that the fabric sheet F is substantially restrained against shifting movement relative to the table 12 by engagement with the pressure sensitive adhesive.

When the fabric has been properly aligned with the table 12, the latch 70 is released allowing the pressure roller assembly 50 to pivot to its active or full line position of FIG. 3, urged by the weight of the pressure roller 60. Thereafter, the support sheet 44 is wound onto the pay-off/take-up reel 46. In the illustrated embodiment a hand crank 72 (FIG. 1) is provided for winding the support sheet 42 onto the roll 46. However, motorized drives may, if desired, be provided for rotating the roll 46 and moving the spreader carriage 28 relative to the table to facilitate operation of the spreader apparatus in response to control signals from the controller 24. As the support sheet 44 is taken up by the roll 46 it is pulled out from under the fabric F, the spreader carriage 28 being pulled toward the rear of the table 12 by the sheet 44.

As the spreader carriage 28 moves toward the rear of the table and relative to the fabric sheet F, the fabric sheet travels over the forward edge of the spreader bar 38 and is engaged by the brush 66 which smooths any wrinkles which may have formed in the fabric as it was spread over the support sheet 44. The pressure roll 64 engages the fabric sheet F as it is laid down upon the surface 20 to remove any remaining wrinkles therefrom and to press it into adhering engagement with the pressure sensitive adhesive surface 20. After the spreader assembly 26 has been moved to its inactive or broken line position of FIG. 1 at the rear of the table 12, the tool carriage assembly 22 is moved to working position relative to the fabric F and the cutter wheel 21 lowered to its cutting position in engagement with the working surface 16. Thereafter the pattern cutting operation proceeds in response to command signals received by the carriage assembly drives from the controller 24.

I claim:

1. In an apparatus for working on limp sheet material and including means defining a sheet material support surface having a high coefficient of static friction relative to the sheet material, the improvement comprising a spreader assembly including a spreader carriage, means supporting said spreader carriage for movement longitudinally of the support surface in one and an opposite direction, a sheet of support material having a low coefficient of static friction relative to the support surface and to the limp sheet material, means for attaching one end portion of the support material to said spreader carriage to move with said spreader carriage and into overlying relation with an associated portion of the support surface in response to advancing movement of said spreader carriage in said one direction relative to said support surface, a pressure roller, and means supporting said pressure roller on the spreader carriage forward of said attaching means for rotation about a transversely extending axis in rolling engagement with said sheet material support surface and with limp sheet material spread thereon.

2. In an apparatus for spreading sheet material as set forth in claim 1, the further improvement wherein said attaching means comprises a spreader bar mounted on said carriage and extending transversely thereof in close proximity to said support surface.

3. In an apparatus for spreading sheet material as set forth in claim 2 the further improvement comprising brush means mounted on and extending transversely of said spreader carriage between said pressure roller and said attaching means for brushing engagement with said support surface and sheet material positioned thereon.

4. In an apparatus for spreading sheet material as set forth in claim 3 the further improvement wherein said brush means is mounted on said pressure roller supporting means.

5. In an apparatus as set forth in any one of claims 1 through 4 the further improvement wherein said pressure roller supporting means is further characterized as means supporting said pressure roller for pivotal movement relative to said spreader carriage between an active position wherein said pressure roller is disposed for rolling engagement with said support surface and an inactive position wherein said pressure roller is disposed in spaced relation to said support surface.

6. In an apparatus for spreading sheet material as set forth in claim 5 the further improvement comprising latching means mounted on said spreader carriage for releasably retaining said pressure roller supporting means in said inactive position.

7. In an apparatus for spreading sheet material as set forth in any one of claims 1 through 4, the further improvement wherein said support material comprises a sheet of flexible sheet material.

8. In an apparatus for spreading sheet material as set forth in any one of claims 1 through 4, the further improvement comprising means for moving said spreader carriage in said opposite direction relative to said support surface.

9. In an apparatus as set forth in claim 8 the further improvement wherein said means for moving said spreader carriage comprises said sheet of support material.

10. In an apparatus as set forth in claim 9 the further improvement wherein said means for moving said carriage includes a pay-off/take-up roll attached to the end portion of said support material opposite said one end portion.

11. A method for spreading limp sheet material on and aligning it in predetermined position relative to a support surface defined by a pressure sensitive adhesive, the sheet material and the support surface having a high coefficient of static friction relative to each other, and comprising the steps of spreading on the support surface a sheet of support material having a low coefficient of static friction relative to the limp sheet material and the support surface, spreading the limp sheet material on the support material so that the side marginal portions of the sheet material extend beyond associated side edges of the support material and overlie associated marginal portions of the support surface, shifting the limp sheet material on and relative to the support material to align the sheet material in said predetermined position, restraining a portion of the limp sheet material against movement relative to the support surface by pressing the side marginal portions of the sheet material into adhering relation with the underlying marginal portions of the support surface, and withdrawing the sheet of support material from its position between the limp sheet material and support surface while the portion of the limp sheet material is restrained against movement relative to the support surface.

12. A method as set forth in claim 11 wherein the step of spreading the limp sheet material is further characterized as spreading the limp sheet material on the support material so that an end portion of the sheet material extends beyond an associated end portion of the support material and overlies an associated portion of the support surface and the step of restraining a portion of the limp sheet material is further characterized as placing a weight on said end portion of the sheet material to hold it in engagement with the underlying portion of the support surface.

13. A method as set forth in claim 11 including the additional step of pressing said limp sheet material into engagement with said support surface while withdrawing said sheet of support material from its position between the limp sheet material and the support surface.

14. The method as set forth in claim 13 wherein the step of pressing is further characterized as moving a pressure roller in rolling engagement with the surface of said limp sheet material.

15. A method as set forth in claim 13 including the additional step of brushing the exposed surface of said limp sheet material while withdrawing said sheet of support material.

16. A method as set forth in claim 15 wherein the steps of pressing and brushing are performed simultaneously with the step of withdrawing the sheet of support material.

* * * * *